US005915151A

United States Patent [19]

Kaneko et al.

[11] Patent Number: 5,915,151

[45] Date of Patent: Jun. 22, 1999

[54] ROTARY-TYPE DEVELOPING UNIT

[75] Inventors: Shintaro Kaneko; Ryuji Hattori; Shigemi Murata; Tetsuji Okamoto; Hirohisa Kohno, all of Ebina, Japan

[73] Assignee: Fuji Xerox Co., Ltd., Tokyo, Japan

[21] Appl. No.: 09/131,278

[22] Filed: Aug. 10, 1998

[30] Foreign Application Priority Data

Aug. 20, 1997 [JP] Japan ..... 9-239033

[51] Int. Cl.[6] ..... G03G 15/01

[52] U.S. Cl. ..... 399/227

[58] Field of Search ..... 399/223, 226, 399/227

[56] References Cited

U.S. PATENT DOCUMENTS 5,655,190 8/1997 Fuchiwaki ..... 399/227
5,671,465 9/1997 Kimura et al. ..... 399/227

FOREIGN PATENT DOCUMENTS

A-7-333978 12/1995 Japan .

*Primary Examiner*—Fred L. Braun
*Assistant Examiner*—William A. Noē
*Attorney, Agent, or Firm*—Oliff & Berridge, PLC

[57] ABSTRACT

A rotary-type developing unit includes: a rotary holder mounting a plurality of developing devices; each of the developing devices having: a developing housing storing a two-component developer consisting of a toner and a carrier and including a developing opening formed in part thereof; a developer carrier disposed opposed to the developing opening of the developing housing and carrying the two-component developer thereon; and a developer delivery member stirring and delivering the developer existing within the developing housing so as to supply the developer to the developer carrier. The developer carriers of the respective developing devices are selectively arranged at a developing position facing a latent image carrier by rotating the rotary holder intermittently, whereby respective color component latent images on the latent image carrier are respectively developed by the respective corresponding developing devices. A developer storing recessed portion where a developer free from the operation of the developer delivery member is stored is formed downwardly of the developer delivery member of the developer housing, in a state in which each of the developing devices is set at the developing position.

4 Claims, 8 Drawing Sheets

PRIOR ART

PRIOR ART

ROTARY-TYPE DEVELOPING UNIT

BACKGROUND OF THE INVENTION

1. Field of the Invention

The present invention relates to a developing unit for use in an image forming apparatus such as an electronic photocopying machine, a printer or the like and, in particular, to an improved a rotary-type developing unit in which a plurality of developing devices are mounted on a rotary holder and, in each of the developing devices, there is used a developer of two components consisting of a given color toner and a carrier for such toner.

2. Description of the Related Art

In recent years, in a copying machine and a printer, there has been increasing a demand for employment of color images.

In an image forming apparatus such as a copying machine, a printer or the like, to obtain color images, there is generally employed a method in which there are installed a plurality of developing devices for developing a plurality of color toners and the plurality of color toners are superimposed on top of another on a record medium.

As means for realizing the color images, there has been put to practical use a so-called rotary type of unit (that is, a rotary-type developing unit) in which developing devices for developing necessary colors are so disposed as to be opposed to photo conductors.

Further, in each of the developing devices, in most cases, there is employed a developing system which uses a two-component developer consisting of a non-magnetic toner and a magnetic carrier. In this developing system, a newly supplied non-magnetic toner must be uniformly mixed with a carrier to be thereby charged electrically to a sufficient degree for development, before the non-magnetic toner reaches a developing area where the non-magnetic toner cooperates with a latent image carrier for development of a latent image carried by the latent image carrier.

In a conventional developing device of a two-component system, in most cases, there has been employed such a method as follows: that is, there is prepared a developing housing which stores therein two-component developer and includes a developing opening formed in part thereof; a developing roller for carrying the two-component developer thereon is so disposed as to face the developing opening of the developing housing; a developer amount restrict member for restricting the amount of the two-component developer carried on the developing roller is disposed around the developing roller; a developer circulating passage used to circulate and deliver the developer along the axial direction of the developing roller is formed on the back surface side of the developing roller of the developing housing; in the developer circulating passage, the developer is circulated while it is being stirred well by two developer delivery members (i.e., augers) which can be driven or rotated in the mutually opposing directions; a toner supply port is formed in a position near the delivery start point of the deeper-side developer delivery member that is spaced apart furthest from the developing roller; in the portion of the developer circulating passage where the developer is attached to a latent image carrier such as a photo conductor or the like, while stirring and delivering the developer already existing in the developing housing with a new toner that is supplied from the toner supply port, the density of the toners are made uniform and the toners are electrically charged; the thus mixed developers and toners are finally turned into layers with the developer amount restrict member; and, after then, development is executed in the developing area.

In the above-mentioned conventional rotary-type developing unit, when the plurality of developing devices respectively use the developers different from each other to thereby form full-color images, the developing devices must be switched over to one another sequentially during the image forming operation. However, in fact, short or poor stirring and mixing of the developers is liable to occur in the respective developing devices, so that the toners cannot be mixed or charged uniformly to a sufficient degree. As a result of this, the uneven toner density and fogging in the background occur easily.

To solve the above technical problems, a conventional developing unit is known in which a guide member is provided near the developer layer restrict member. The excessive developers restricted by the developer layer restrict member are stored on the guide member. When the developing devices are sequentially moved by the rotation of the rotary holder, the stored developers on the guide member are discharged into the developers in the developing housing, thereby making up for the inadequate stirring and mixing of the developers described above (see Japanese Patent Publication No. 7-333978 of Heisei and the like).

With use of this type of developing unit, since the developers are stirred and mixed in the respective developing devices even when the rotary holder is rotated, the above-mentioned various technical problems due to the inadequate stirring and mixing of the developers may be solved.

By the way, when the present inventors have studied the relation between the developer weight (g) of the developers existing in the respective developing devices and the developed density difference (IN/OUT) of the output image after 10 sheets of images and 20 sheets of images have been formed, for example, in a 4-color mode (that is, a full-color mode), there are obtained such results as shown in FIG. 8. From these results, it is found that, when the developer weight (g) of the respective developing devices is increased, the developed density difference (IN/OUT) is decreased, so that the density stability can be enhanced. That is, based on this knowledge, the present inventors have conducted an elaborate examination on a demand for increasing the developer weight (g) of the respective developing devices as much as possible.

Now, in the above-mentioned type of developing unit, when a rotary-type developing unit must be made compact, the sizes of the respective developing devices to be incorporated into the rotary-type developing unit are limited and, as an inevitable consequence of this, the developer amount itself contained in the developing devices is limited greatly. Therefore, it is impossible to increase the developer weight and thus the life of the developer is liable to be short. Also, there is found a new technical problem that the developing unit of this type is complicated in structure.

SUMMARY OF THE INVENTION

The present invention aims at eliminating the above-mentioned technical problems. Accordingly, it is an object of the invention to provide a rotary-type developing unit which not only can satisfy the need for reducing the size thereof but also, by using a simplified structure, can avoid the poor stirring and mixing of developers effectively, thereby being able to extend the life of the developer used therein.

To achieve the above object, there is provided a rotary-type developing unit including: a rotary holder mounting a plurality of developing devices; each of the developing devices having: a developing housing storing a two-component developer consisting of a toner and a carrier and including a developing opening formed in part thereof; a developer carrier disposed opposed to the developing opening of the developing housing and carrying the two-component developer thereon; and a developer delivery member stirring and delivering the developer existing within the developing housing so as to supply the developer to the developer carrier. The developer carriers of the respective developing devices are selectively arranged at a developing position facing a latent image carrier by rotating the rotary holder intermittently, whereby respective color component latent images on the latent image carrier are respectively developed by their respective corresponding developing devices. A developer storing recessed portion where a developer free from the operation of the developer delivery member can be stored is formed downwardly of the developer delivery member of the developer housing, in a state in which each of the developing devices is set at the developing position.

BRIEF DESCRIPTION OF THE DRAWINGS

Similar reference characters denote corresponding features consistently throughout the attached drawings. The preferred embodiments of this invention will be described in detail, with reference to the following figures, wherein.

DETAILED DESCRIPTION OF THE PREFERRED EMBODIMENTS

Figure 1:
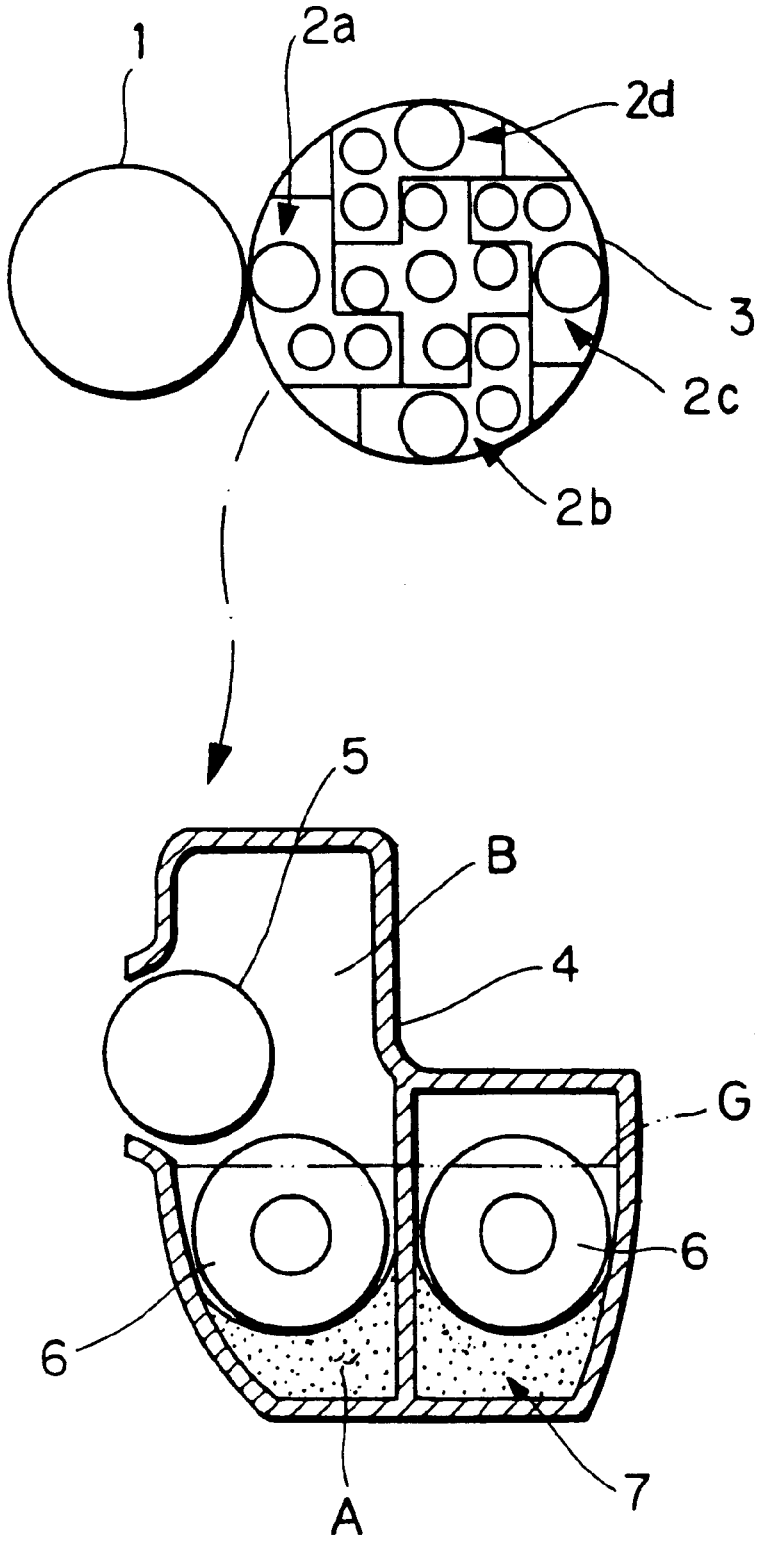
FIG. 1 is an explanatory view of a rotary-type developing unit according to the invention.

Now, a main portion of the invention will be described with reference to FIG. 1.

In a rotary-type developing unit, a plurality of developing devices 2 (in particular, 2*a* to 2*d*) are mounted on a rotary holder 3; each of the developing devices 2 includes a developing housing 4 for storing therein a two-component developer G consisting of a toner and a carrier, the developing housing 4 including a developing opening formed in part thereof, a developer carrier 5 so disposed as to be opposed to the developing opening of the developing housing 4 and carrying the two-component developer G thereon, and a developer delivery member 6 for stirring and delivering the developer existing within the developing housing 4 to supply the developer to the developer carrier 5; the developer carriers 5 of the respective developing devices 2 are selectively arranged at a developing position facing a latent image carrier 1 by rotating the rotary holder 3 intermittently; and, the respective color component latent images on the latent image carrier 1 are respectively developed by their corresponding developing devices. While each of the respective developing devices 2 is positioned at the developing position, in the portion of the developing housing 4 that is located downwardly of the developer delivery member 6 of the developing housing 4, there is formed a developer storing recessed portion 7 where a developer G free from the operation of the developer delivery member 6 can be stored.

In the present technical means, as the developing device 2, any type of developing device can be used, provided that it includes on the back surface of the developer carrier 5 the developer delivery member 6 capable of stirring and delivering the developer G; for example, there can also be employed such a developing device which includes a developer supply member such as a paddle, a roller, or the like between the developer carrier 5 and developer delivery member 6.

Also, the forming position of the developer storing recessed portion 7 is not limited to the substantially whole area below the developer delivery member 6, but the developer storing recessed portion 7 may also be formed in a portion of the whole area; and, the shape of the developer storing recessed portion 7 can also be selected properly according to cases.

Further, the capacity of the developer storing recessed portion 7 can also be selected properly within an allowable range (that is, the storage range of the developing device 2 of the rotary holder 3). However, from the viewpoint that the developers G can be stirred more effectively within the developing housing 4 while the rotary holder 3 is rotated, the capacity of the developer storing recessed portion 7 is expressed as A and the capacity of the non-storage space of the developer G within the developing housing 4 is expressed as B, the relation "A<B" may be satisfied.

By the way, within the developing housing 4, for example, in order to form a developer circulating passage through which the developer G is circulated and delivered, there are formed partition walls or the like. However, in order to secure the desired stirring or mixing operation of the developer G within the developing housing 4 during the rotation of the rotary holder 3, it is preferable to secure the widest possible area in which the developer G can be moved within the developing housing 4.

Next, description will be given below of the operation of the above-mentioned technical means.

In FIG. 1, in the developing device 2*a* set in the developing position, the developer G free from the operation of the developer delivery member 6 collects and is stored in the developer storing recessed portion 7.

However, in a process in which the developing device 2*a* set in the developing position is moved with the intermittent rotation of the rotary holder 3, the setting posture of the developing housing changes moment by moment; and, therefore, the developer stored in the developer storing recessed portion 7 move sequentially within the developing housing 4 to be stirred and mixed with other developers.

Next, description will be given below in detail of the invention by means of a preferred embodiment thereof shown in the accompanying drawings.

Figure 2:
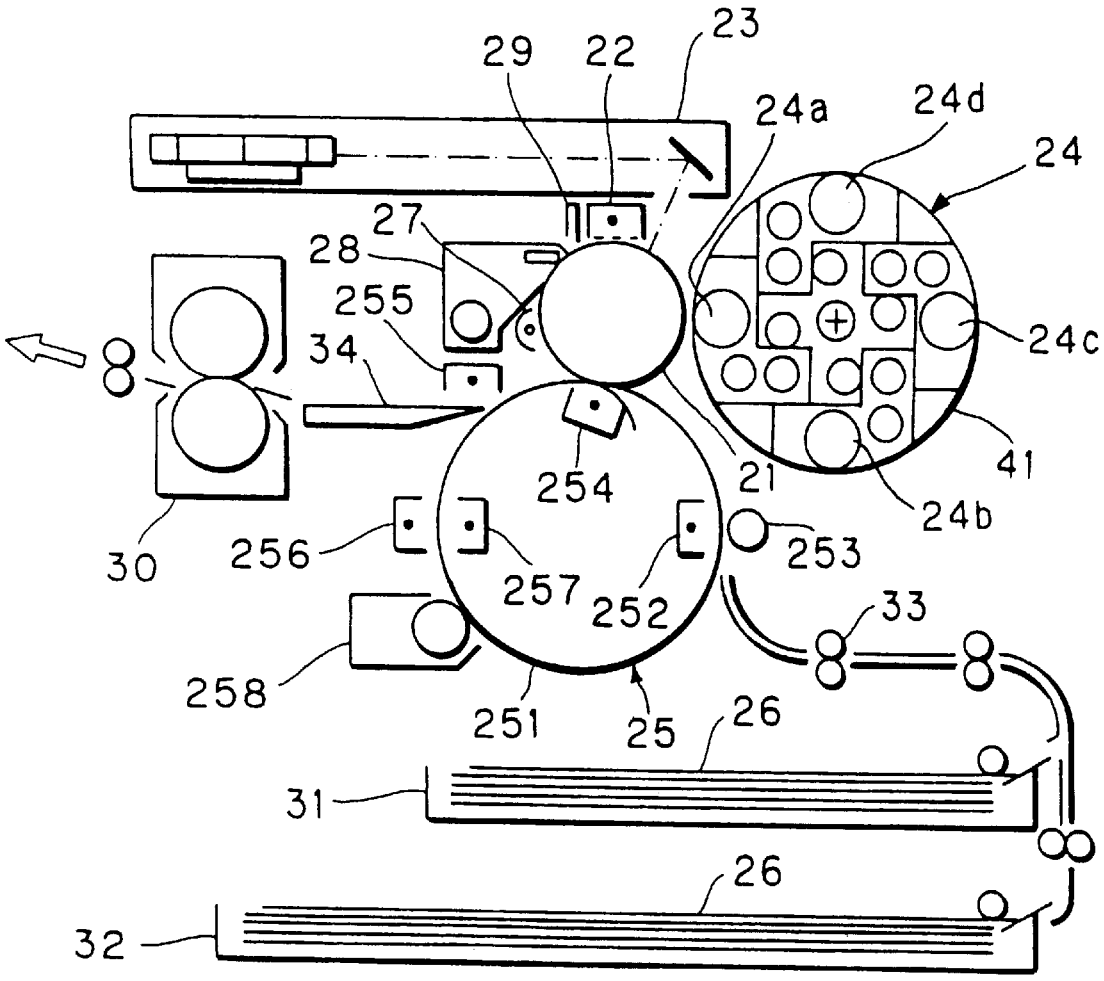
FIG. 2 is an explanatory view of the general structure of a full color image forming apparatus which incorporates therein the rotary-type developing unit according to the invention.

In particular, FIG. 2 is a schematic structure view of a full color image forming apparatus of an electrophotographic type which incorporates therein an embodiment of the rotary-type developing unit according to the invention.

In FIG. 2, reference character 21 designates a latent image carrier such as a photoconductor drum or the like; 22 a uniform charge device which is used to charge the latent image carrier 21 uniformly; 23 an exposure device such as a laser scanner or the like which is used to write an electrostatic latent image on the charged latent image carrier 21; 24 a rotary-type developing unit on which there are mounted rotatably a black developing device 24*a* having a black developer, a yellow developing device 24*b* having a yellow developer, a magenta developing device 24*c* having a magenta developer, and a cyan developing device 24*d* having a cyan developer, while the respective developing devices 24*a*–24*d* can be intermittently rotated and moved to a developing position so set as to face the latent image carrier 21; 25 a transfer device which is used to transfer the respective color toner images on the latent image carrier 21 to a transfer member 26 such as a form, a transparent sheet or the like; 27 a pre-cleaning process charge device which is used to remove charges from the latent image carrier 21 or charge the latent image carrier 21 prior to a cleaning step in order to facilitate the cleaning process of the latent image carrier 21; 28 a cleaning device which is used to remove the residual toners on the latent image carrier 21; 29 a charge removing device used to remove the residual charges on the latent image carrier 21; and, 30 a fixing device for fixing the unfixed toner images on the transfer member 26.

Also, reference characters 31 and 32 respectively designate transfer member supply trays which are used to supply the transfer members 26 of given sizes, 33 stands for registration rollers used to restrict the supply timing of the transfer member 26 to the transfer device 25, and 34 represents a delivery guide member for delivering and guiding the transfer member 26, after the transfer step is finished, to the fixing device 30.

Furthermore, the transfer device 25 includes a transfer drum 251 which can be rotated in a given direction. The peripheral surface of the transfer drum 251 is covered with an insulation sheet. The absorbing portion of the transfer drum 251 is located upstream of the rotation direction of the transfer portion of the transfer drum 251. An absorbing charge device 252 and an absorbing charge roller 253 are disposed so the transfer drum 251 is interposed between them, while the transfer member 26 can be electrostatically absorbed in the transfer drum 251 due to the absorbing charge device 252 and the absorbing charge roller 253. Also, a transfer charge device 254 is disposed in the portion of the transfer drum 251 corresponding to the above-mentioned transfer portion. Furthermore, in the peel-off portion of the transfer device 25 located further downstream of the rotation direction of the transfer portion of the transfer drum 251, a peel-off discharge device 255 is disposed to peel off the transfer member 26 from the transfer drum 251. Additionally, even further downstream the rotation direction of the transfer drum 251, there are disposed a pair of discharge devices 256 and 257 with the transfer drum 251 interpose there between. Even further, further downstream of the rotation direction of the transfer drum 251, there is disposed a cleaning device 258 which is used to remove the residual paper powder and the like on the transfer drum 251.

In addition, in the present embodiment, each time the transfer drum 251 is rotated one lap, a reference signal can be taken out from a position sensor (not shown) and, in accordance with the reference signal, a rotary holder drive (not shown) can be driven at a proper timing.

Figure 3:
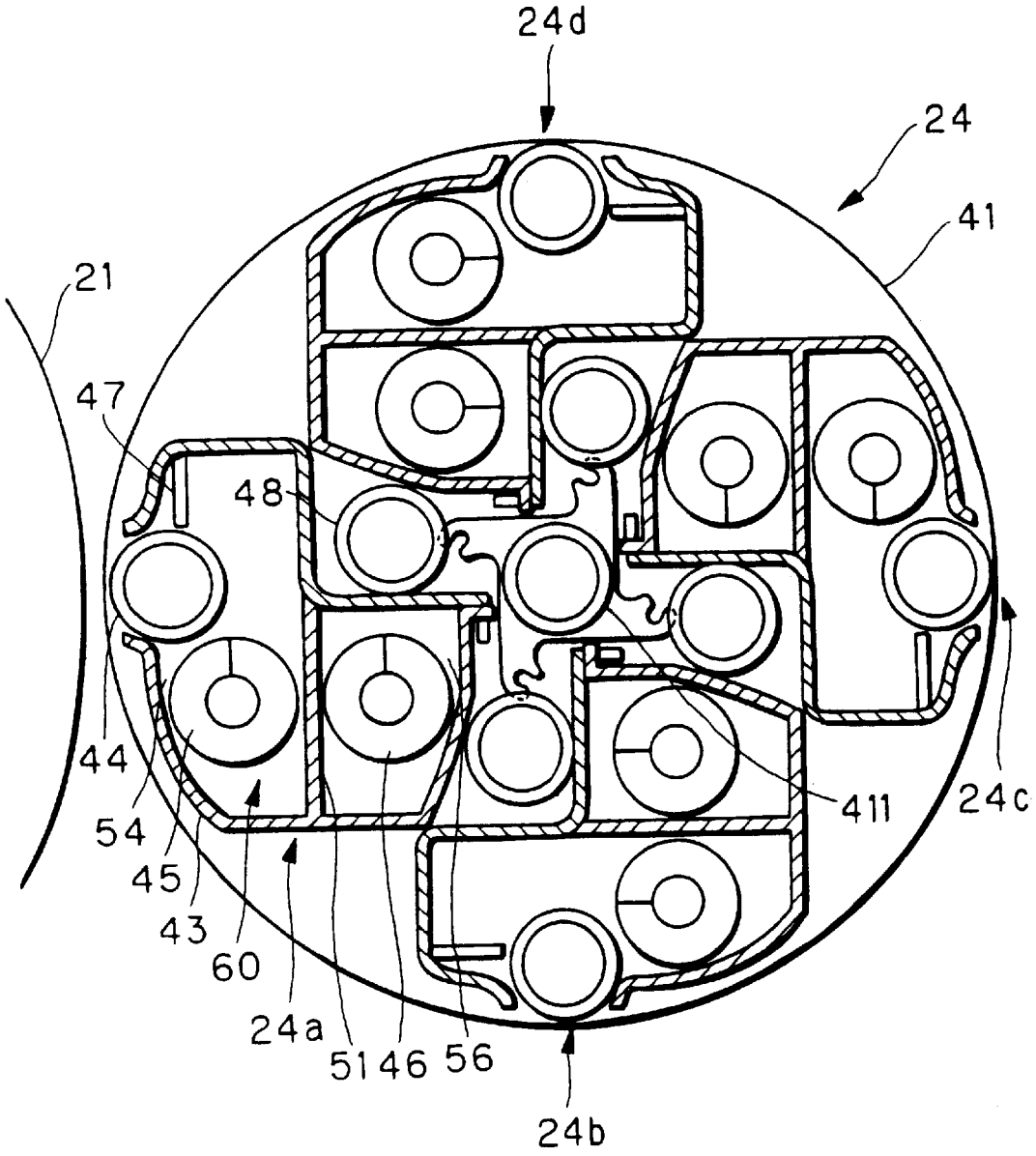
FIG. 3 is a longitudinal section view showing the details of the rotary-type developing unit according to the invention.

Further, in the present embodiment, the rotary-type developing unit 24 is structured such that, as shown in FIG. 3, the respective developing devices 24*a*–24*d* (in the present embodiment, there is employed a two-component magnetic brush developing system) are mounted on a rotary holder 41 rotatably about a rotary shaft 411; and, by driving and rotating the rotary holder 41, the respective developing devices 24*a*–24*d* can be selectively set at the developing position so disposed as to be opposed to the latent image carrier 21.

Figure 4A:
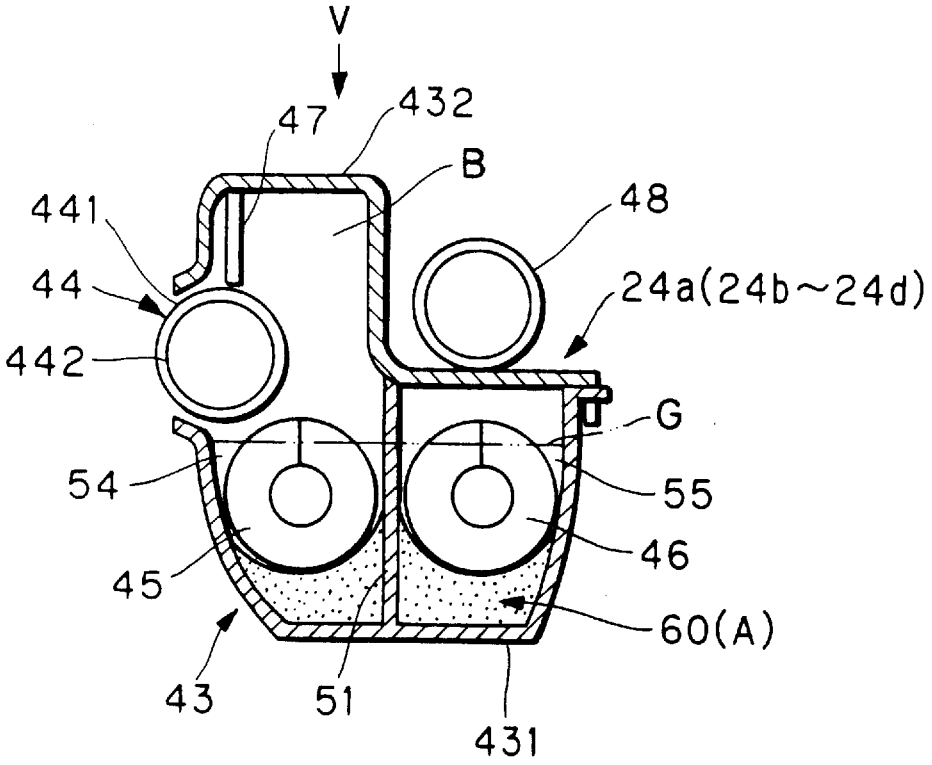
FIG. 4A is an explanatory view showing the details of a developing device to be mounted in the rotary-type developing unit according to the invention.
Figure 5:
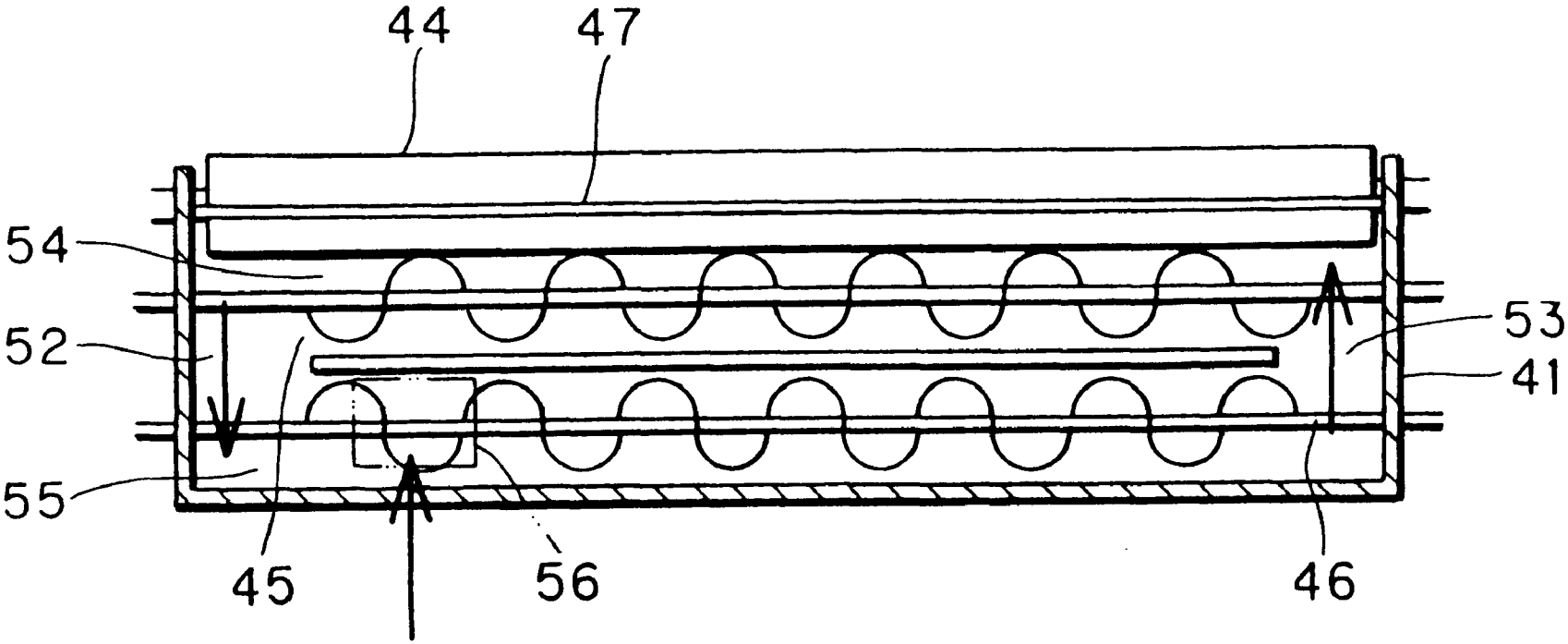
FIG. 5 is an arrow view of the developing device viewed from an arrow V shown in FIG. 4A, with part of the developing housing thereof omitted.

Here, each of the developing devices 24*a*–24*d*, as shown in FIGS. 3, 4A and 5, includes a developing housing 43 having an opening which, for example, when the developing device is set at the developing position, can be so situated as to face the latent image carrier 21; in the portion of the developing device that faces the opening of the developing housing 43, there is disposed a developing roller 44; in the interior portion of the developing housing 43 that is located on the back surface side of the developing roller 44, there is formed a developer circulating passage through which the developer can be circulated and delivered; in the developer circulating passage, there are disposed a pair of delivery and stir augers 45 and 46; and, on near side of the developing portion of the developing roller 44, there is provided a developer amount restrict member 47 in such a manner that it is spaced apart from the developing roller 44.

Also, reference character 48 designates a toner supply and delivery member which is used to supply a given amount of toner stored within a toner cartridge mounted on the exterior portion of the developing housing 43.

By the way, in the present embodiment, the developing housing 43, as shown in FIG. 4A, is composed of a lower housing 431 and an upper housing 432 which is removably connected to the lower housing 431 in such a manner that it covers the top portion of the lower housing 431.

Further, in the present embodiment, the developing roller 44 includes a rotatable developing sleeve 441 in which a magnetic roller 442 having a plurality of magnetic poles is contained in a fixed manner, while the developing roller 44 can be rotationally driven at a given distance from the peripheral surface of the latent image carrier 21.

Also, the developer circulating passage is formed in such a manner that, in the bottom portion of the developing housing 43, there is so erected a partition plate 51 as to extend along the axial direction of the developing roller 44 and there are opened up two communication ports 52 and 53 respectively adjacent to the two ends of the partition plate 51; and, the developer circulating passage, when it is viewed from the developing roller 44 side, is divided into a first developer storage portion 54 and a second developer storage portion 55 with the partition plate 51 between them. By the way, reference character 56 designates a toner supply port which is formed in the second developer storage portion 55 adjacently to the delivery starting point of the delivery and stir auger 46, while a toner cartridge (not shown) is connected in communication with the toner supply port 56 through the toner supply and delivery member 48.

Further, the pair of delivery and stir augers 45 and 46 are respectively disposed in the first developer storage portion 54 and second developer storage portion 55 and are also structured such that, after they deliver and circulate the developers in the mutually opposing directions to thereby stir and mix the toner and carrier to a sufficient degree, they deliver the thus obtained mixture as the developers to the developing sleeve 441.

In particular, the delivery and stir augers 45 and 46 serve as both delivery members and stir members which are rotated in the mutually opposing directions: that is, due to the driving force of the stir screws thereof, the augers 45 and 46 deliver the toners supplied by the toner cartridge (not shown) and toner supply and delivery member 48 and, at the same time, due to the mixing action of the toner with the magnetic carrier, they frictionally charge the developers.

Especially, in the present embodiment, in the portion of the developing housing 43 that is situated downwardly of the delivery and stir augers 45 and 46, that is, on the lower housing 431 side of the developing housing 43, there is formed a developer storing recessed portion 60 in which the developer free from the developer delivery operations of the delivery and stir augers 45 and 46 can be stored.

Figure 4B:
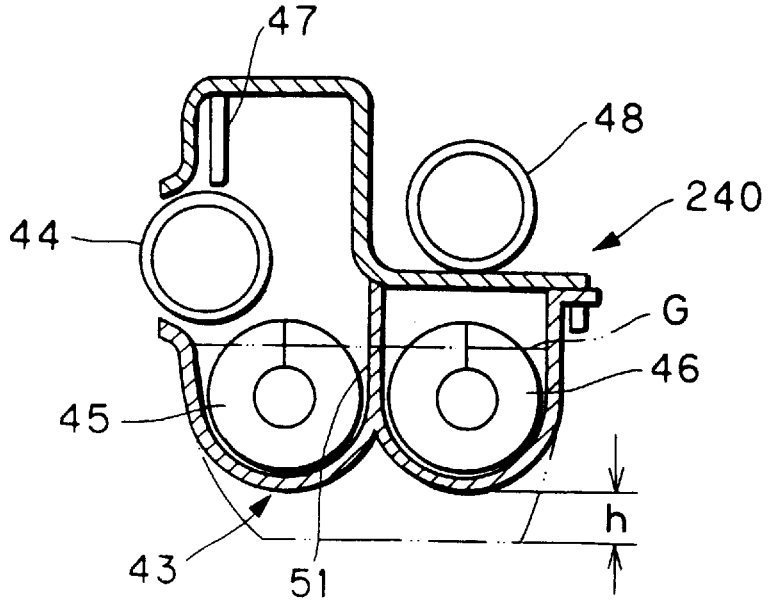
FIG. 4B is an explanatory view showing the details of a developing device to be mounted in a rotary-type developing unit according to a comparison model.
Figure 7:
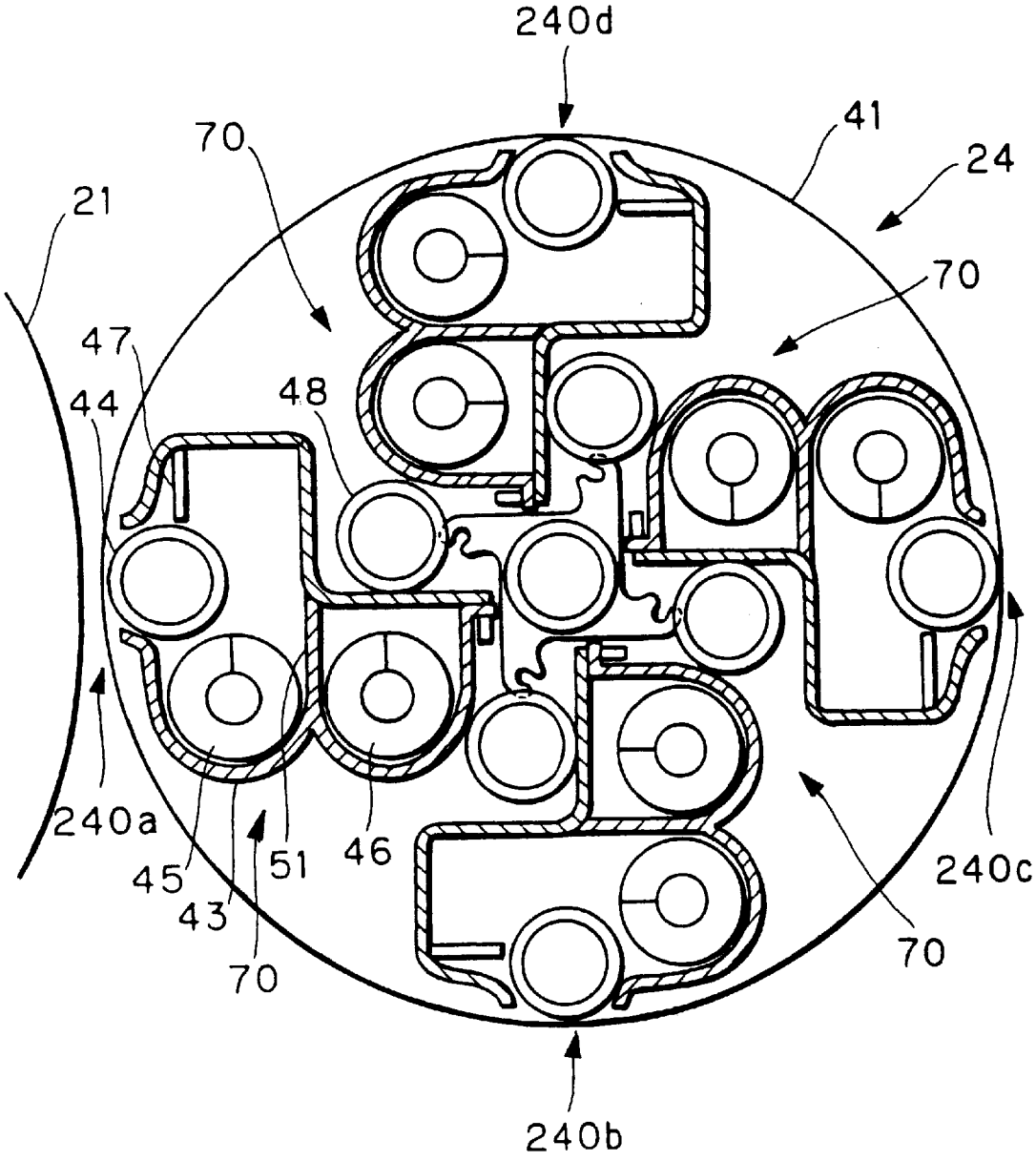
FIG. 7 is an explanatory view showing an example of the rotary-type developing unit incorporating therein developing devices according the comparison model; and, FIG. 8 is a graphical representation of the relation between the developer weight and the developing density difference (IN/OUT) of the output image after 10 sheets of images and 20 sheets of images are output, in a 4-color mode.
Figure 8:
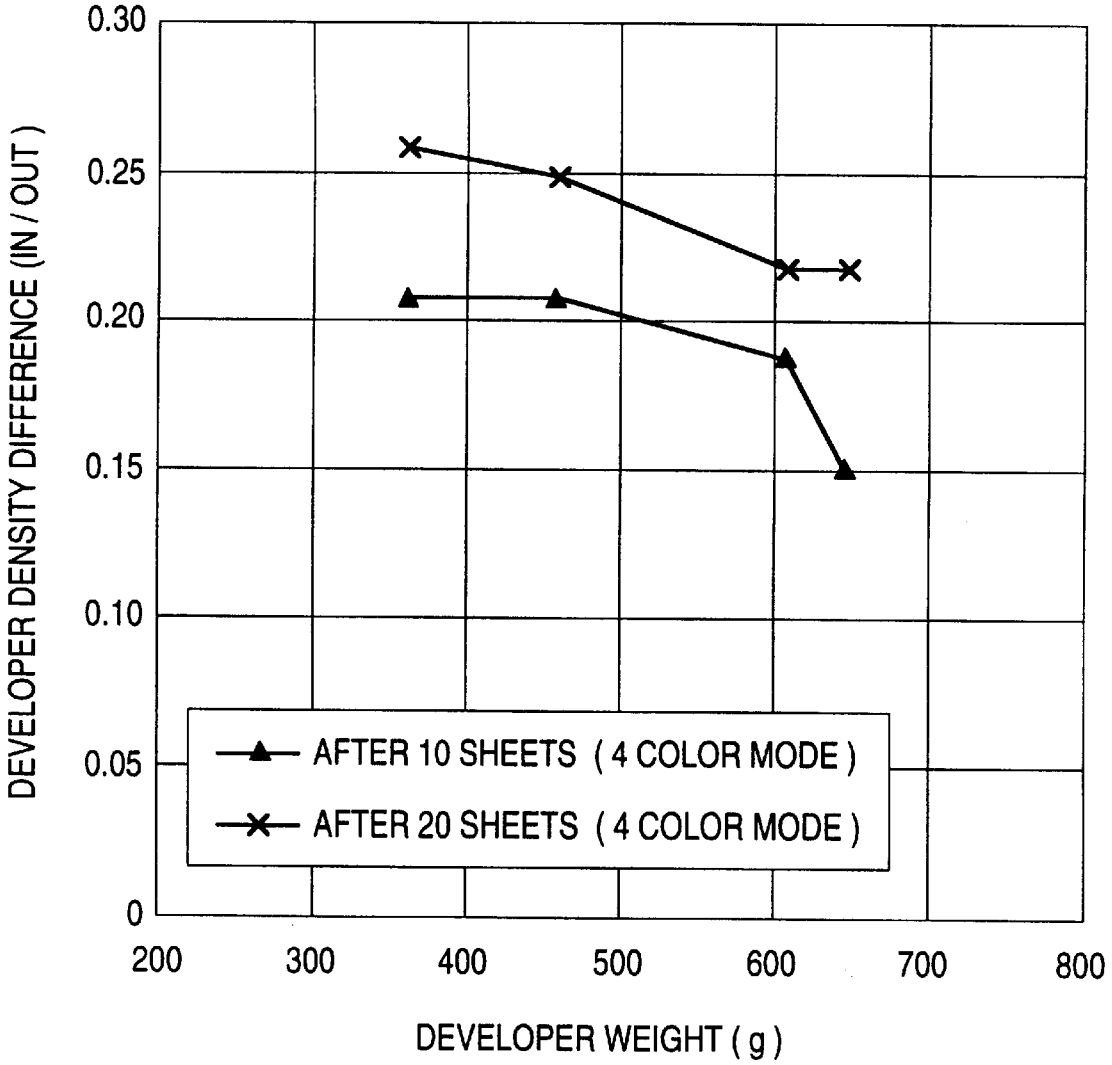

The developer storing recessed portion 60 increases the height dimension of the developing housing 43 by h (in FIG. 4B, a two-dot chained line shows the outer shape of the developing housing 43) when compared with a developing device 240 (see FIG. 4B) according to a comparison model in which the developer storing recessed portion 60 is not formed. However, originally, in an embodiment in which a plurality of developing devices 240 (in particular, 240*a*–240*d*) according to the comparison model are incorporated into the rotary holder 41, as shown in FIG. 7, there are formed dead spaces 70 respectively between the developing devices 240 in the rotary holder 41 and, therefore, the developer storing recessed portion can be secured by use of the dead spaces 70.

In the present embodiment, if the capacity of the developer storing recessed portion 60 is expressed as A and the developer non-storage space in the developing housing 43 (which corresponds to a space obtained by deducting the developer amount stored in the developing housing 43 from the capacity of the developing housing 43) is expressed as B, the developer storing recessed portion 60 is set in such a manner that the relation "A<B" can be satisfied.

Next, description will be given below of the image forming process of a color image forming apparatus according to the present embodiment.

At first, the surface of the latent image carrier 21 such as a photoconductor drum or the like is uniformly charged by the charge device 22, for example, into negative polarity. Next, an image corresponding to a first color, for example, a black image is exposed by the laser scanning device (exposure device) 23, so that an electrostatic latent image corresponding to the black image is formed on the surface of the latent image carrier 21.

At that time, in the rotary-type developing unit 24, before the leading end portion of the electrostatic latent image corresponding to the black image reaches the developing position, the black developing device 24*a* is so set as to face the latent image carrier 21 and, thereafter, the black developing device 24*a* is rotated and the magnetic brush slides and rubs the electrostatic latent image, so that a black toner image is formed on the latent image carrier 21.

On the other hand, the transfer member 26 such as a form, a transparent sheet or the like is fed from the tray 31 or 32 and the leading end of the transfer member 26 is stopped by the registration roller 33; and the transfer member 26 is then sent out to the transfer drum 251 at a given timing. The thus sent-out transfer member 26 is delivered by the sticking device (that is, sticking charge device 252 and sticking charge roller 253) to the transfer area in which the transfer drum 251 and latent image carrier 21 are so disposed as to be opposed to each other, while the transfer member 26 is being held by the transfer drum 251 electrostatically. In the transfer area, the transfer member 26 is brought into close contact with the black toner image on the latent image carrier 21, the black toner image is transferred onto the transfer member 26 due to the operation of the transfer charge device 254, and the transfer drum 251 prepares for the next step while holding the transfer member 26.

By the way, if the transfer of the black toner image is finished, after a pre-cleaning treatment is enforced on the latent image carrier 21 as the need arises, the residual black toners left on the surface of the latent image carrier 21 are scraped off by the cleaning device 28 and, further, the charges left on the surface of the latent image carrier 21 are removed by the electricity removing device 29.

Next, to form a second color image, for example, a yellow image, the surface of the latent image carrier 21 is charged uniformly into negative polarity by the charge device 22, and then an image corresponding to the yellow image is exposed by the laser scanning device 23, so that the electrostatic latent image of the yellow image is formed on the surface of the latent image carrier 21.

Also, in the rotary-type developing unit 24, after the formation of the black toner image is completed, the yellow developing device 24b has been so switched as to face the latent image carrier 21, while the electrostatic latent image corresponding to the yellow image is developed by a yellow magnetic brush. And, the transfer member 26, which has been held on the transfer drum 251, is delivered again to the transfer area and, due to the operation of the transfer charge device 254, a yellow toner image is superimposingly transferred onto the black toner image.

In the latent image carrier 21, after the transfer of the yellow toner image is completed, similarly to the black image forming step, the residual toners left on the surface thereof are cleaned and the residual charges on the surface thereof are removed; and, on the other hand, the transfer member 26 with the yellow toner image transferred thereto waits for execution of the next step, while it is being held by the transfer drum 251.

After then, similarly to the yellow image forming step, a third color image, for example, a magenta image is formed and, finally, a fourth color image, for example, a cyan image is formed. On completion of the transfer of the fourth color image, the transfer member 26 is separated from the transfer drum 251 by peel-off fingers (not shown) provided on the leading ends of the peel-off charge removing device 255 and delivery guide member 34, respectively, and the multiple toner image is fixed to the transfer member 26 by the fixing device 30. Then, the transfer member 26 is discharged externally of the image forming apparatus.

Also, in the transfer drum 251, after the separation of the transfer member 26 is finished, the residual charges on the surface of the transfer member 26 are removed by the charge removing devices 256 and 257, and the surface of the transfer member 26 is then cleaned by the cleaning device 258; and, after then, the transfer drum 251 waits for the supply of the next transfer member 26.

During the above-mentioned image forming process, especially, the rotary-type developing unit 24 operates in the following manner:

Here, description will be given below of an embodiment in which the rotary-type developing unit 24 is rotated clockwise, with reference to FIG. 6.

Figure 6:
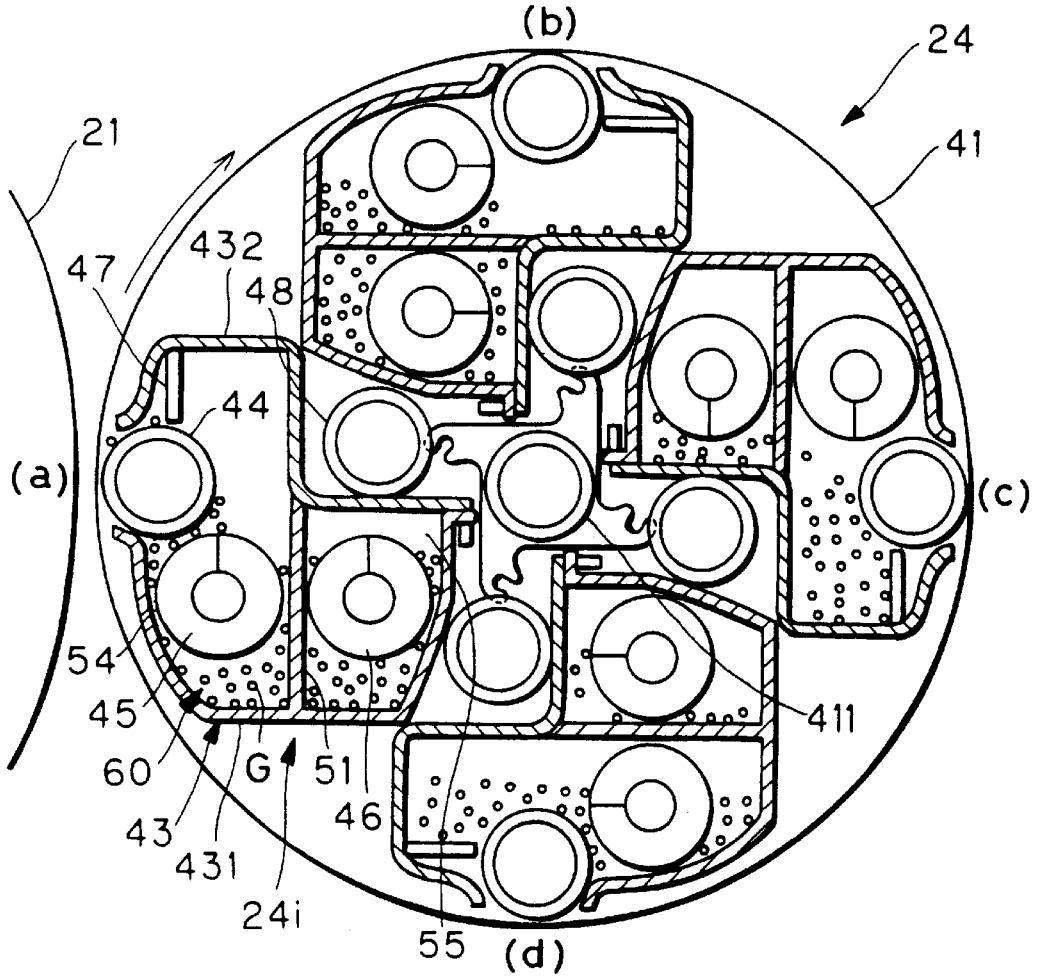
FIG. 6 is an explanatory view of the behaviors of developers within the respective developing devices when the rotary-type developing unit according to the invention is rotated.

In FIG. 6, the rotary-type developing unit 24 is rotated about a shaft extending in parallel to the longitudinal direction of the developing devices 24*a*–24*d* (see FIG. 2) and, according to the colors to be developed, it stops at positions (a), (b), (c) and (d), where the developing devices 24*a*–24*d* are driven to thereby form their respective toner images on the latent image carrier 21.

In the present embodiment, the developing devices 24*a*–24*d* are arranged in the order of K color, Y color, M color, and C color.

Here, special attention is paid to the operation of a typical developing device 24*i* (any one of the four developing devices 24*a*–24*d*) for a certain color. On completion of a developing operation at the developing position (a), in order to develop other remaining colors, the developing device 24*i* stops sequentially at the positions (b), (c) and (d) in this order; and, at the respective developing positions, the developer G existing in the developing device 24*i* moves according to the direction of the developing device 24*i* in such a manner as shown in FIG. 6.

While the developing operation by the developing device 24*i* for a certain color is being executed, the developer G within the developer storing recessed portion 60 of the present developing device 24*i* remains stored there and does not contribute to the developing operation.

Then, if the developing operation by the developing device 24*i* is finished and the developing device 24*i* moves to the positions (b) and (c) for the purpose of development of the next color and the color after next, the developer G storing within the developer storing recessed portion 60, due to the change of the posture of the developing housing 43, is moved to the upper housing 432 side, where it is mixed with the other developers.

Since the non-storage space capacity of the developers is secured in such a manner that it is wider than that of the developer storing recessed portion 60, most of the developer G stored within the developer storing recessed portion 60 is discharged from the developer storing recessed portion 60 once.

Further, if the developing device 24*i* is further moved to the position (d), then the developer G clustering on the lower side of the first developer storage portion 54 at the position (c) is caused to spread out to the whole area of the first developer storage portion 54, so that part of the developer existing within the second developer storage portion 55 is moved to the first developer storage portion 54 through the communication ports 52 and 53 (see FIG. 5).

In addition, while the developing device 24*i* reaches the developing position (a) again, the developer G spread out to the whole of the first developer storage portion 54 is moved to the lower housing 431 side directly or through the communication ports 52 and 53.

With use of the above-mentioned structure, due to the rotation of the rotary-type developing unit 24, the developers G existing within the developing device 24*i* are previously mixed within the developing housing 43, so that the toners of the developers G supplied to the developing operation can be mixed and electrically charged in a sufficiently uniform manner.

Therefore, according to the present embodiment, it is confirmed that the image quality defects (that is, the uneven toner density and the fogging of the background portion) caused by the insufficient mixing of the developers are eliminated completely and thus an excellent image quality can be provided.

Also, according to the present embodiment, since the developer amount is increased by an amount corresponding to the capacity of the developer storing recessed portion 60 when compared with the comparison model (see FIG. 4B), it is confirmed that the life of the developer can be extended to such extent.

As has been described heretofore, according to the invention, in a rotary-type developing unit which includes a plurality of developing devices mounted on a rotary holder, in the developing housing of each of the developing devices, there is formed a developer storing recessed portion where a developer free from the operation of a developer delivery member can be stored, and, when the rotary holder rotates, as the developing housing varies in posture, the developer existing within the developer storing recessed portion is stirred and mixed with the other developers. Thanks to this, while avoiding the poor mixing of the developers effectively, the developer capacity of the developing housing can be increased. Also, since there are provided a plurality of developer delivery members, the developer capacity can be increased further. Further, because the capacity of the top portion of the developer delivery member located nearest to a developing roller is set largest in the capacity B, the developers stirred and mixed by the developing roller can be supplied.

As a result of this, not only the image quality defects (for example, the uneven toner density, the fogging in the background portion, and the like) due to the poor stirring and mixing of the developers can be avoided but also the developer capacity can be increased, thereby being able to extend a developer replacement interval (which leads to the extended life of the developer).

Especially, in the invention, since the dead space within the rotary holder is used to secure a space for formation of the developer storing recessed portion in part of the developing housing, the rotary-type developing unit can be made compact and, at the same time, by use of a simplified structure, the poor stirring and mixing of the developers can be avoided effectively and the life of the developer can be extended.

What is claimed is:

1. A rotary-type developing unit comprising:

a rotary holder mounting a plurality of developing devices; each of said developing devices including:

a developing housing storing a two-component developer consisting of a toner and a carrier and including a developing opening formed in part thereof;

a developer carrier disposed opposed to said developing opening of said developing housing and carrying said two-component developer thereon; and a developer delivery member stirring and delivering said developer existing within said developing housing so as to supply said developer to said developer carrier;

wherein said developer carrier of each developing device of said developing devices is selectively arranged at a developing position facing a latent image carrier by rotating said rotary holder intermittently, whereby respective color component latent images on the latent image carrier are respectively developed by said developing devices, and further wherein a developer storing recessed portion where said developer which is free from the operation of said developer delivery member is stored is formed downwardly of said developer delivery member of said developing housing, in a state in which said each developing device is set at said developing position.

2. The developing unit of a rotary type as set forth in claim 1, wherein, when the capacity of said developer storing recessed portion is expressed as A and the capacity of a developer non-storage space in said developing housing in said each developing device within which said developer is able to move with the rotation of said developer carrier is expressed as B, then the relation A<B is satisfied.

3. The developing unit of a rotary type as set forth in claim 1, wherein said each developing device comprises a plurality of developer delivery members.

4. The developing unit of a rotary type as set forth in claim 2, wherein said each developing device comprises a plurality of developer delivery members and an amount of developer-free space in said developer non-storage space is largest when said developing carrier of said each developing device is selectively arranged to face said latent image carrier at said developing position.

* * * * *